US009987869B2

(12) United States Patent
Thibierge et al.

(10) Patent No.: US 9,987,869 B2
(45) Date of Patent: Jun. 5, 2018

(54) REFILL FOR STATIONERY ITEM, AND STATIONERY ITEM COMPRISING SUCH A REFILL

(75) Inventors: Emeric Philippe Marie Thibierge, Asnieres (FR); Patrice Girona, Lamorlaye (FR)

(73) Assignee: PAPERLAB PARIS, Chateau-Gaillard (FR)

( * ) Notice: Subject to any disclaimer, the term of this patent is extended or adjusted under 35 U.S.C. 154(b) by 51 days.

(21) Appl. No.: 14/127,881

(22) PCT Filed: Jun. 21, 2011

(86) PCT No.: PCT/FR2011/051420
§ 371 (c)(1),
(2), (4) Date: Dec. 19, 2013

(87) PCT Pub. No.: WO2012/175821
PCT Pub. Date: Dec. 27, 2012

(65) Prior Publication Data
US 2014/0125047 A1 May 8, 2014

(51) Int. Cl.

| | |
|---|---|
| ***B42D 3/04*** | (2006.01) |
| ***B42D 1/00*** | (2006.01) |
| ***B42D 19/00*** | (2006.01) |
| ***B42D 5/00*** | (2006.01) |
| ***B42D 1/08*** | (2006.01) |
| ***B42F 5/00*** | (2006.01) |
| ***B42D 3/00*** | (2006.01) |

(Continued)

(52) U.S. Cl.
CPC ..... *B42B 5/00* (2013.01); *B42D 1/06* (2013.01); *B42D 3/02* (2013.01); *B42D 3/04* (2013.01); *B42D 3/10* (2013.01)

(58) Field of Classification Search
CPC . B42D 1/00; B42D 3/04; B42D 19/00; B42D 5/00; B42D 1/08; B42D 3/00; B42D 7/00; B42D 15/00; B42F 5/00
USPC ..... 281/2, 3.1, 4, 5, 10, 14, 15.1, 16, 17, 281/19.1, 20, 21.1, 22, 23, 27.3, 29, 38, 281/44, 45; 283/82, 85
See application file for complete search history.

(56) References Cited

U.S. PATENT DOCUMENTS

| | | | |
|---|---|---|---|
| 1,564,233 | A | 12/1925 | Goldstein |
| 4,547,000 | A | 10/1985 | Sallinen |

(Continued)

FOREIGN PATENT DOCUMENTS

| | | | |
|---|---|---|---|
| FR | 2592837 | A3 | 7/1987 |
| WO | 1982/03824 | A1 | 11/1982 |
| WO | 2007/127451 | A2 | 8/2007 |

*Primary Examiner* — Justin V Lewis
(74) *Attorney, Agent, or Firm* — McDonnell Boehnen Hulbert & Berghoff LLP

(57) ABSTRACT

Disclosed is a stationery item that includes a cover and removable contents forming a refill. The refill includes: a block of stacked pages forming two main outer surfaces by a certain thickness; a binding that binds the pages of the block together at the back of the block; and a flexible covering strip that covers the binding. The covering strip includes: a back portion which outwardly covers the binding and which is provided with magnetic elements, and two side portions that are attached to both of the main surfaces of the block, respectively. The refill can be removably attached to the back of the cover which includes built-in magnetic means for attracting the magnetic elements of the refill.

20 Claims, 6 Drawing Sheets

(51) Int. Cl.

| | |
|---|---|
| ***B42D 17/00*** | (2006.01) |
| ***B42B 5/00*** | (2006.01) |
| ***B42D 1/06*** | (2006.01) |
| ***B42D 3/02*** | (2006.01) |
| ***B42D 3/10*** | (2006.01) |

(56) References Cited

U.S. PATENT DOCUMENTS

| | | | | | |
|---|---|---|---|---|---|
| 4,588,209 | A * | 5/1986 | Zebrowski | B42D 3/00 | 281/45 |
| 5,575,503 | A * | 11/1996 | Takahashi | B42F 7/00 | 281/21.1 |
| 5,702,126 | A * | 12/1997 | Engel | B42D 5/005 | 281/27.3 |
| 2007/0252377 | A1 | 11/2007 | El-Sorroge | | |
| 2011/0233916 | A1 * | 9/2011 | Howard | B42D 1/00 | 281/43 |

* cited by examiner

FIG.6.
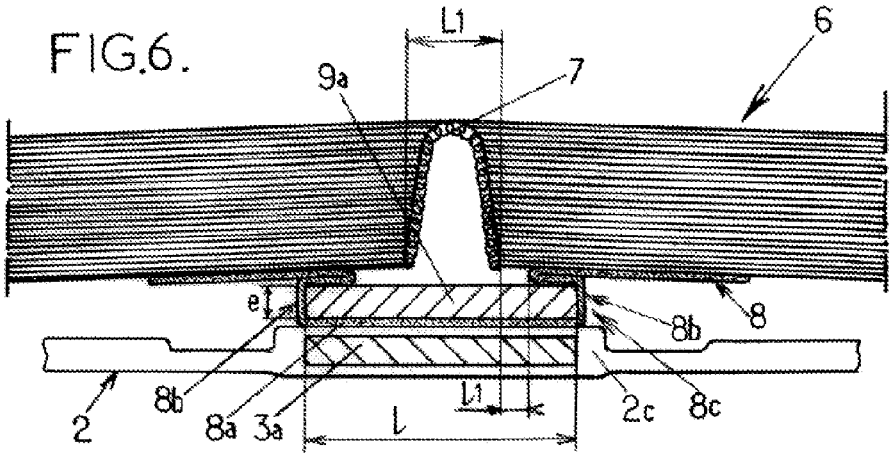
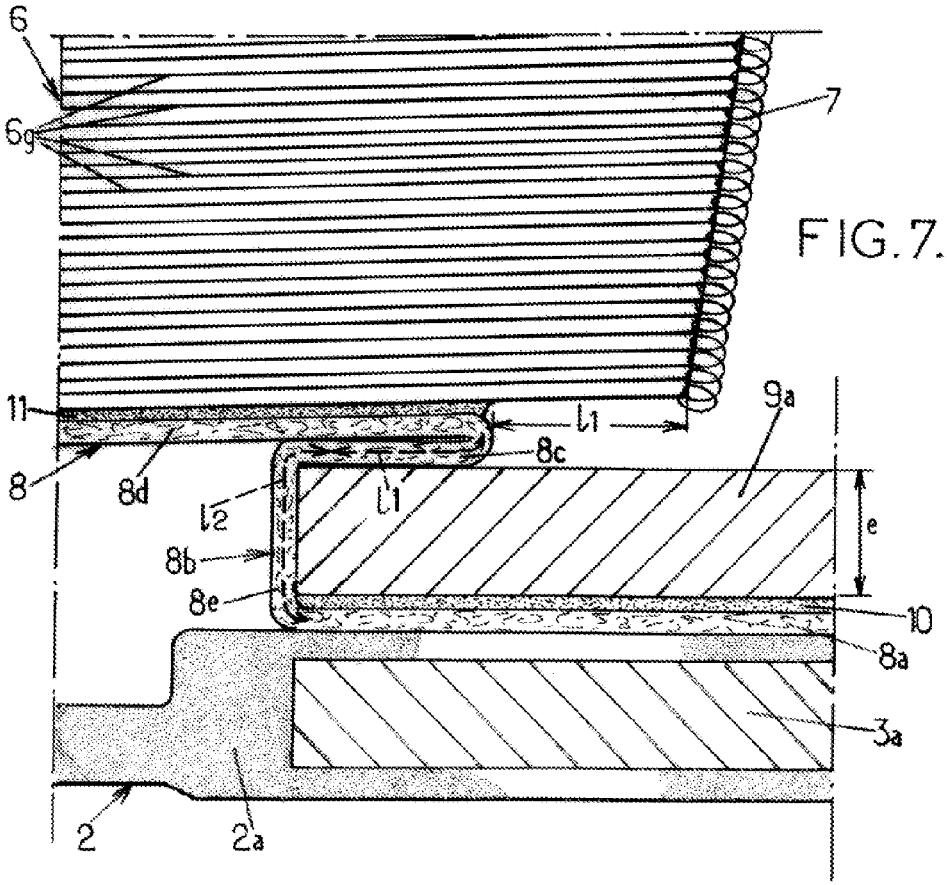
FIG.7.

REFILL FOR STATIONERY ITEM, AND STATIONERY ITEM COMPRISING SUCH A REFILL

This application is a U.S. national phase of International Application No. PCT/FR2011/051420, filed Jun. 21, 2011, the disclosure of which is hereby incorporated by reference in its entirety.

FIELD OF THE INVENTION

The present inventions concerns refills for stationery items, and stationery items comprising such refills.

In general, the invention relates to the field of stationery items with a cover and removable contents, which allows for example changing the contents while keeping the protective cover. These items can be ledgers, notebooks, notepads, appointment books, or other items, of any format.

More specifically, the invention relates to a refill for a stationery item, comprising:

- a pad (or "block") of pages, comprising a plurality of stacked pages, said pad of pages forming:
  - two main outer surfaces separated by a certain thickness,
  - a spine (or "back") defining said thickness at one side of the pad,
- a binding that binds the pages of the pad together at the spine of the pad,
- magnetic means, arranged at the spine of the pad and adapted to attach by magnetic attraction to a cover of the stationery item.

TECHNOLOGICAL BACKGROUND OF THE INVENTION

Document WO 2007/127451 describes a refill of this type, which attaches by magnetic attraction to the inside face of the spine of a protective cover. The spine of the refill described in this document comprises a magnetic element which can stiffen the binding of the pad of pages and make it more difficult to open the pages. This difficulty in opening the pages may lead the user to force them open by pressing on the central portion of the refill, which may damage the refill.

OBJECTS OF THE INVENTION

The present invention is intended to overcome some or all of these disadvantages.

To this end, the invention proposes a refill of the above type which further comprises a flexible covering strip having:

- a spine portion (or "back portion") which externally covers the binding, and
- two side portions which are respectively attached to the two main surfaces of the pad of pages and are connected to the spine portion, the spine portion of the covering strip being provided with said magnetic means.

Due to this covering strip, the magnetic means are separate from the refill binding and therefore they do not or they only slightly increase the difficulty of opening the pages of the refill.

In various embodiments of the refill according to the invention, one or more of the following arrangements may be used:

- the magnetic means comprise a ferromagnetic material;

- said ferromagnetic material is permanently magnetized;
- said ferromagnetic material is a metal;
- the covering strip is less than 1 mm in thickness, preferably less than 0.5 mm;
- the magnetic means comprise at least one magnetic element integral with the spine portion of the covering strip;
- the spine portion of the covering strip has a certain thickness and said magnetic element is included within said thickness;
- said magnetic element is attached to the spine portion of the covering strip facing the binding of said pad;
- the spine portion of the covering strip is integral with at least two magnetic elements spaced apart along the spine of the refill;
- the magnetic elements are arranged asymmetrically on the spine of the refill relative to a 180° rotation of the refill about an axis perpendicular to the spine of the refill;
- the magnetic elements are permanent magnets with non-parallel polarization relative to each other;
- the magnetic means comprise at least one magnetic material integrated into the material of the spine portion of the covering strip;
- each of the two side portions of the covering strip comprises:
  - a free and flexible intermediate portion which extends laterally from the spine portion and is not attached to the corresponding main surface of the pad of pages,
  - and an end portion which extends from said intermediate portion and is attached to said corresponding main surface of the pad of pages (this is a particularly good arrangement for allowing the pages to open);
- the spine portion of the covering strip has a certain width and the magnetic means comprise at least one rigid magnetic element which extends over a width that is less than the width of the spine portion, the spine portion having two free and flexible side strips which are not covered by said magnetic element and which connect to said side portions of the covering strip (this is a particularly good arrangement for allowing the pages to open).

The invention also relates to a stationery item comprising:

- a refill as defined above,
- a cover comprising at least a front cover board, a back cover board, and a spine connecting the front and back cover boards, the spine being provided with magnetic means adapted for attracting the magnetic means of the refill.

In various embodiments of the stationery item of the invention, one or both of the following arrangements may be used:

- the magnetic means of the refill comprise at least one magnetic element integral with the spine portion of the covering strip and the spine of the cover comprises at least one complementary magnetic element adapted for magnetically attracting the magnetic element of the refill and arranged in correspondence with said magnetic element of the refill;
- the magnetic means of the refill comprise a plurality of magnetic elements integral with the spine portion of the covering strip and the spine of the cover comprises a plurality of complementary magnetic elements each adapted for magnetically attracting a magnetic element of the refill and arranged in correspondence with said magnetic element of the refill.

BRIEF DESCRIPTION OF DRAWINGS

Other features and advantages of the invention will become apparent from the following description of several of its embodiments, given by way of non-limiting examples, with reference to the accompanying drawings in which:

FIG. 6 is a detail view showing the spine of the stationery item of FIG. 5;

FIG. 7 shows an enlargement of part of FIG. 6;

DETAILED DESCRIPTION

The same references are used to denote identical or similar elements in the different figures.

First Embodiment

Figure 1:
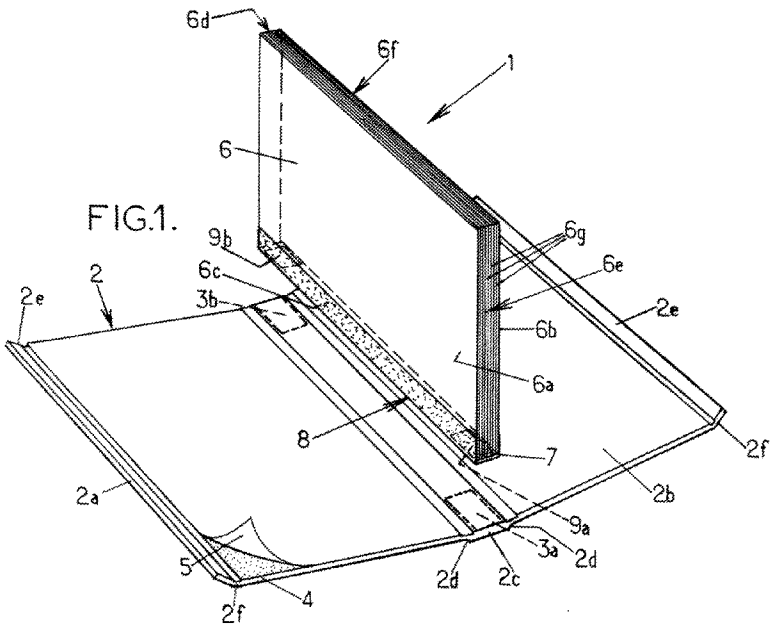
FIG. 1 is a perspective view showing a stationery item according to a first embodiment of the invention.

The invention relates to a stationery item 1 of which a first embodiment is shown in FIG. 1.

This stationery item 1 may be a notebook or similar item which includes a cover 2 and a refill 6.

The cover 2 comprises:

a front cover board 2*a*, a back cover board 2*b*, and a spine 2*c* defining the thickness of the stationery item 1, this spine 2*c* being respectively connected to the cover boards 2*a*, 2*b* by two hinges 2*d* formed for example as two thinned lines in the cover 2 and extending on either side of and along said spine 2*c*.

Optionally, each of the cover boards 2*a*, 2*b* may be extended, at its edge opposite the spine 2*c*, by a hinged flap 2*e* connected to the corresponding cover board by a hinge 2*f* formed for example as a thinned line in the cover 2.

Figure 3:
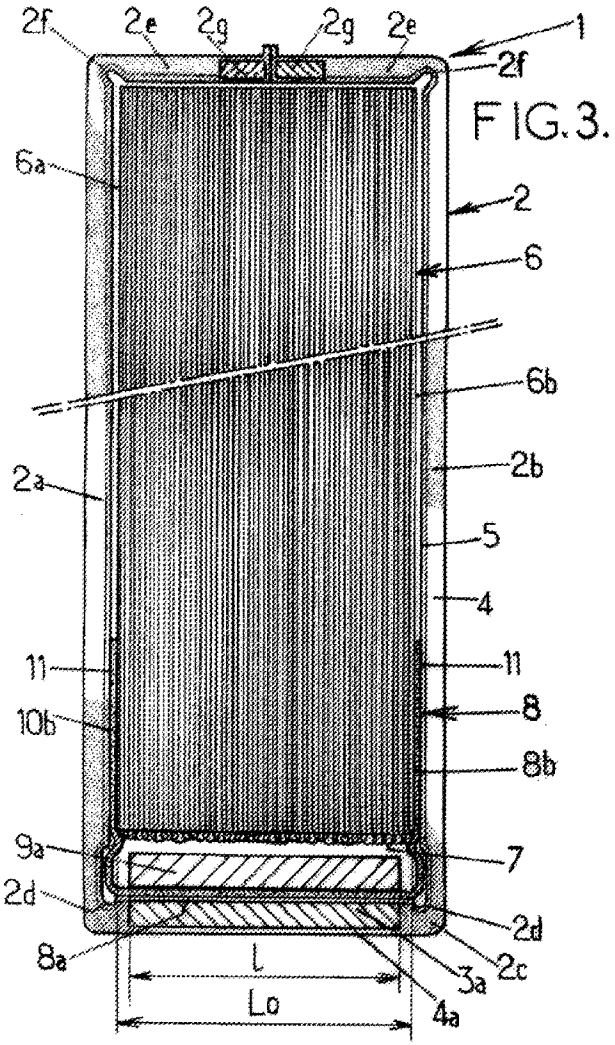
FIG. 3 is a cross-sectional view of an item according to the invention in its completely closed position.

As shown in FIG. 3, the flaps 2*e* can each have a width equal to about half the thickness of the stationery item 1 and can be folded towards each other to 90° relative to the cover boards 2*a*, 2*b* so as to come into mutual contact, edge to edge, when the stationery item 1 is closed. The flaps 2*e* may contain permanent magnets 2*g* or other magnetic elements, which are arranged to be facing one another from one flap 2*e* to the other and which are adapted to attract one another and keep the edges of the flaps 2*e* against each other by magnetic attraction when the item 1 is in the closed position. When the item 1 is in the open position, the flaps can unfold to lie flat as an extension of the cover boards 2*a*, 2*b*.

The inside face of the spine 2*c* of the cover 2 is provided with magnetic means which, in the example considered here, may consist of one or more permanent magnets, for example two permanent magnets 3*a*, 3*b* in the embodiment shown (see FIG. 1).

The cover 2 may be created in any known manner, of rigid or flexible material. For example, said cover 2 may include a thick outer layer 4 made for example of cardboard or other material, possibly covered with an outer covering of leather, textile, paper or other material (not shown), this thick layer 4 also being covered with an inner lining 5 of paper or other material. The inner lining is relatively thin, for example 0.5 mm or less. In the example shown, said magnets 3*a*, 3*b* can be glued into recesses 4*a* in the thick layer 4 and covered on the inside surface of the item 1 by the inner lining 5, which is in contact with said magnets. Of course, the magnets 3*a*, 3*b* can be attached in any other manner to the inside face of the spine 2*c* of the cover 2.

Figure 2:
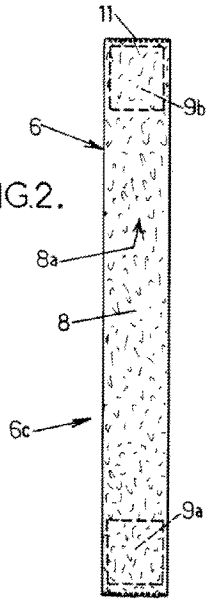
FIG. 2 is a side view showing the spine of the refill of the stationery item shown in FIG. 1.

As shown in FIGS. 1 and 2, the stationery item 1 also comprises a refill 6, forming a pad of sheets of paper 6*g* stacked and assembled together by a binding 7. The refill 6 has:

a main front face 6*a* and a main back face 6*b*, formed for example by sheets of paper which are identical to the other sheets 6*g* or are thicker, and four edges 6*c*-6*f* defining the thickness of the refill 6, these edges comprising a spine 6*c*, an upper edge 6*d* or top edge, a lower edge 6*e* or bottom edge, and an edge 6*f* opposite the spine, called the front edge.

As shown in FIGS. 1-3, the pages 6*g* of the refill 6 are joined together by a binding 7 at the spine 6*c* of the refill. This binding 7 may be of any known type; it may for example comprise a glued cloth attached by adhesive bonding and possibly stitching along the spine 6*c* edge of the pages 6*g*.

The refill 6*b* further includes a relatively thin flexible covering strip 8 (for example less than 1 mm thick, preferably about 0.5 mm or less) which covers the outside of the binding 7 and at least a portion of the main front and back faces 6*a*, 6*b*. This covering strip 8 may consist for example of cloth or paper or other material.

In the example shown, the covering strip 8 more specifically comprises:

a spine portion 8*a* covering the binding 7 on the outside, and two side portions 8*b* respectively attached, by adhesive bonding or other means, to the two main surfaces 6*a*, 6*b*, of the pad of pages 6*g*, and connected to the spine portion 8*a*.

The spine portion 8*a* of this covering strip 8 incorporates magnetic means which are adapted to be attracted by the magnetic means of the spine 2*c* of the cover 2, enabling removable attachment of the refill 6 to the cover 2. In the example shown in FIGS. 1 to 3, the magnetic means of the covering strip 8 are permanent magnets 9*a*, 9*b* which are arranged opposite the permanent magnets 3*a*, 3*b* of the cover and which have polarities arranged so that the corresponding magnets 3*a*, 3*b* and 9*a*, 9*b* attract one another by magnetic attraction.

Of course, the magnets 9*a*, 9*b* may be replaced by any other part of ferromagnetic material, whether permanently magnetized or not, for example metal parts or magnetic materials obtained by mixing adhesives with powder containing magnetic particles or based on a ferrous metal, or a combination thereof.

The arrangement of the magnets 9*a*, 9*b* may optionally be asymmetric relative to a rotation of the refill about an axis perpendicular to the spine 6*c*, meaning relative to a rotation of the refill 6 that reverses the top edge 6*d* and the bottom edge 6*e*. In this case, the magnets 3*a*, 3*b* or the other magnetic elements of the cover 2 are also arranged asymmetrically, in correspondence with the magnets 9*a*, 9*b*. This foolproof arrangement forces the user to place the refill 6 in the proper direction inside the cover 2, particularly when the pages 6*g* of the refill contain information that assumes a predefined orientation of the pages 6*g* (for example if the item 1 is an appointment book or similar item).

Alternatively or additionally, it is possible to achieve such foolproofing by orienting the polarities of the magnets 9*a*, 9*b* differently from one magnet to the other (for example by inverting the polarity between magnets 9*a* and 9*b*) so that the attachment by magnetic attraction is achieved in only one position of the refill 6 relative to the cover 2. Of course, in this case, the polarities of the magnets 3*a*, 3*b* are arranged so that a north pole of one magnet 3*a*, 3*b* respectively corresponds to the south pole of the corresponding magnet 9*a*, 9*b*.

By way of non-limiting example, the magnets 3*a*, 3*b*, 9*a*, 9*b* may be parallelepipedal in shape and may be magnetized in the longitudinal direction (the longitudinal direction of the spine 6*c*), although the magnets may have a different shape (for example an oblong or circular disk).

The arrangement of the magnets 9*a*, 9*b* in the refill 6 will now be further described in relation to FIGS. 1-7.

Figure 4:
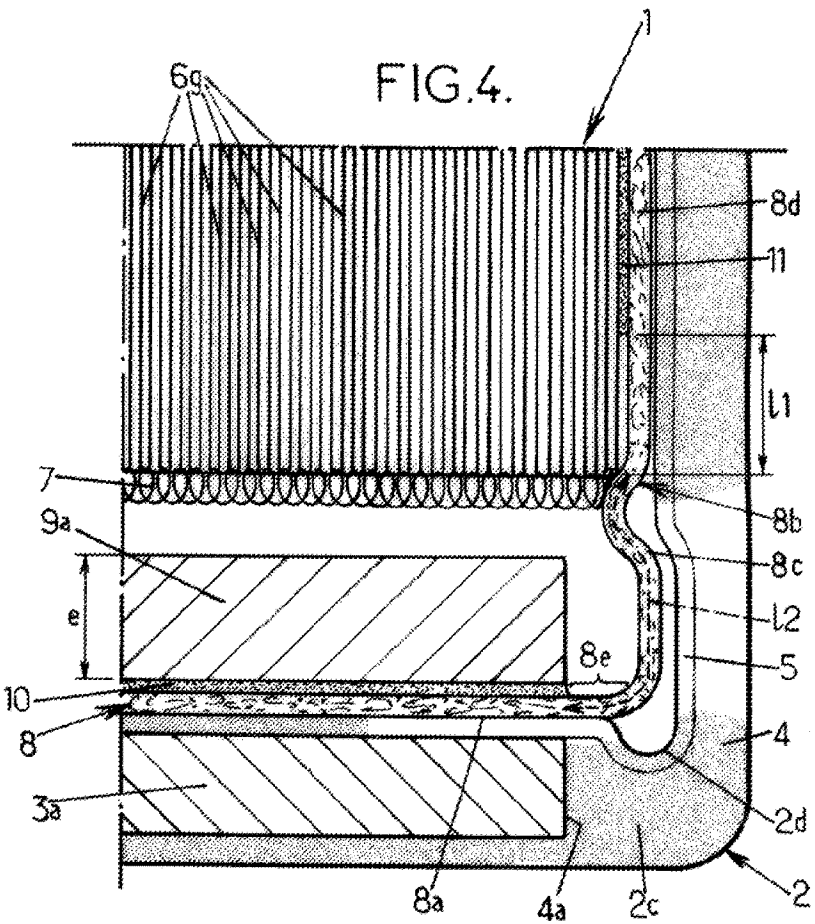
FIG. 4 is a detail view showing the spine of the stationery item shown in FIG. 3.

The magnets 9*a*, 9*b* are, for example, glued by a layer of adhesive 10 to the inside of the spine portion 8*a* of the covering strip 8, facing the binding 7, as can be seen in the more detailed view in FIGS. 3 and 4, without adhering to the pages 6*g* of the pad or to its binding 7. A space of a few millimeters can potentially be left between the magnets 9*a*, 9*b* and binding 7. Because the magnets 9*a*, 9*b* or other magnetic means are incorporated into the covering strip 8 and in particular are arranged on the inner face of its spine portion 8*a*, these magnetic means are easily attached to the refill in a very reliable manner at a low cost and without interfering with opening the pages 6*g* of the refill.

When the refill 6 is attached to the cover 2, magnets 9*a*, 9*b* are only separated from magnets 3*a*, 3*b* by the thickness of the covering strip 8, inner lining 5, and adhesive layer 10, totaling less than 1.2 mm for example, or even less than 1 mm, between magnets 3*a*, 3*b* and the corresponding magnets 9*a*, 9*b*.

Each of the magnets 9*a*, 9*b* or similar magnetic elements extends here for a width l which is between for example 60 and 100% of the thickness $L_0$ of the pad of sheets forming the refill 6, this width l advantageously being between 70 and 90% of $L_0$. When the width l is less than the thickness $L_0$, the spine portion 8*a* then has two free and flexible side strips 8*e* which are not covered by the magnets 9*a*, 9*b* and which connect to the side portions 8*b*.

Other arrangements are possible for the magnets, for example replacing each of the magnets 9*a*, 9*b* with two or more magnets placed beside one another along the width of the spine portion 8*a*. In this case, with a similar arrangement of the complementary magnetic elements 3*a*, 3*b*, a magnetic guiding effect can be obtained when attaching the cover 2 by choosing a different orientation of the polarities for the respective magnetic pairs.

Referring to FIGS. 3 and 4, the side portions 8*b* of the covering strip 8 can be divided into different longitudinal portions as follows:

- a free and flexible intermediate portion 8*c* which laterally extends the spine portion 8*a;*
- an end portion 8*d* which extends the intermediate portion 8*c* and which is attached for example by a layer of adhesive 11 to the corresponding main surface 6*a*, 6*b* of the pad of pages 6*g*.

While both side portions 8*b* are represented here as having a longitudinal attachment portion 8*d* whose width is significantly less than the width of the pages 6*g* in the pad, it is also possible to have side portions 8*b* which cover the entirety of the main surfaces 6*a*, 6*b*.

In the closed position represented in FIG. 4, one can specifically see that the free and flexible intermediate portion 8*c* has, in the extension of the end portion 8*d*, a first sub-portion whose width $I_1$ is sufficient to allow displacement of the pages 6*g* of the pad during their rotational movement relative to the magnets 9*a*, 9*b*, as will be explained below. This first sub-portion of width $I_1$ is held parallel to the pages 6*g* of the pad in the closed position.

The remainder of the intermediate portion 8*c* defines, with the side strip 8*e* at the edge of the spine portion 8*a*, a second sub-portion of width $I_2$ (curvilinear width, as shown in FIG. 4) which is complementary to the first sub-portion of width $I_1$. In the closed position, this second longitudinal sub-portion of width $I_2$ forms a flexible connection between the spine portion 8*a* and the first sub-portion of width $I_1$. Preferably, the width $I_2$ is substantially greater than the thickness e of the magnets 9*a*, 9*b*, this thickness e being measured perpendicularly to the spine portion 8*a*.

Figure 5:
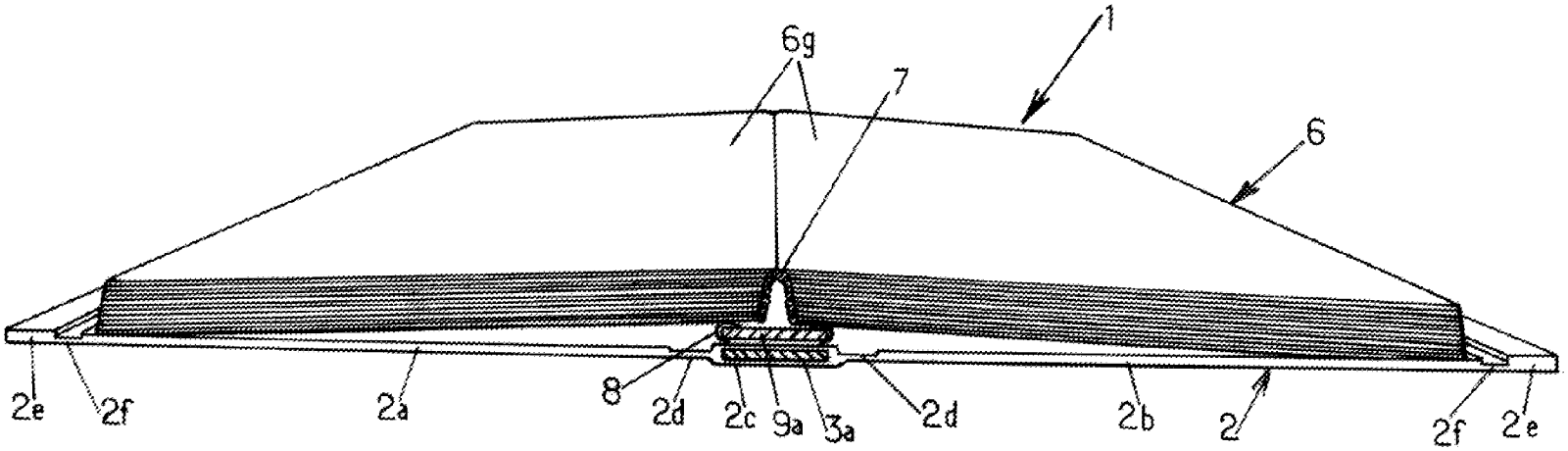
FIG. 5 is a perspective view of a transverse cross-section, showing the stationery item of FIGS. 1-4 in an open position.

As can be seen in FIGS. 5-7, the above arrangements allow the pages 6*g* to open easily, unhindered by the magnets 9*a*, 9*b*, so that the pages 6*g* can lie substantially flat when open, unlike a conventional binding.

When a user opens the pages of the refill 6, the second sub-portion of width $I_2$ bends first, then the first sub-portion of width $I_1$ bends in turn to achieve the flat open position shown in FIGS. 5 to 7. This flat open position is permitted by the flexibility given to the binding 7 by the covering strip 8, which allows the binding 7 to conform to the arch of the open refill 6, as shown in FIGS. 6 and 7. In this position, the two lateral edges of the binding 7 (initially separated by thickness $L_0$ before opening) draw closer to one another until they are separated by a distance $L_1$ which can be less than $L_0/3$ for example.

It is understood that the narrowing of this distance increases with the width $I_1$. One can thus choose $I_1$ to be between ⅛ and ¼ of the width l of magnet 9*a*. This narrowing also increases with the free width $I_2$, which is particularly dependent on the width of the free side strips 8. To simplify, in this particular non-limiting example shown in FIGS. 6-7, we have the relation:

$$I=L_1+4\cdot I_1+2\cdot(I_2-e) \quad (1)$$

Referring to FIGS. 6-7, when the refill 6 is in the open position, the sub-portion of width $I_2$ preferably covers at least the entire thickness of the adjacent side face of the magnet 9*a* or 9*b*. In addition, in this position, the sub-portion of width $I_1$ covers at least a portion of the face of the magnet 9*a*, 9*b* which is facing the binding 7. This sub-portion of width $I_1$ extends to a longitudinal folding region, which corresponds to where the intermediate free portion 8*c* and the end portion 8*d* connect.

It can be seen that after the pages 6*g* are opened, this reliably results in the complete folding of each of the foldable longitudinal portions 8*c* against the adjacent end portion 8*d* which remains attached to the pad of pages 6*g*. With this folding along the main surfaces 6*a*, 6*b* of the pad 6, the folding of the binding 7 is not prevented at the attachments to the spine portion 8*a* where the magnetic elements 9*a*, 9*b* are arranged.

In this first embodiment, the flexibility of the covering strip 8 is between the spine portion 8*a* and the end portion 8*d*. Of course, the flexibility may also be achieved by using only the sub-portion of width $I_1$ not attached to the pad of pages 6*g* or only the sub-portion of width $I_2$, possibly with the introduction of additional play by leaving space between the magnets 9*a*, 9*b* and the binding 7.

In this embodiment, the refill 6 has a compact shape and essentially comprises the pad of pages 6*g* with its binding 7, the covering strip 8, and the magnetic elements 9*a*, 9*b*. The refill 6 can thus have a substantially parallelepipedal volume when the pad of pages 6*g* is in the closed position. As can be seen in FIG. 3, the flaps 2*e* of the cover 2, equipped with complementary magnetic elements 2*g*, prevent the refill 6 from detaching, for example when there is an external impact on the spine 4 of the cover 2. Other non-magnetic devices, similarly located at the edge opposite the spine 4, may also be used to maintain the cover 2 in the closed position as an alternative to using flaps 2*e* and/or magnetic elements 2*g* in the flaps 2*e*.

Although the illustrated example shows a single refill 6 attached to the cover 2, it should be understood that multiple refills can be attached, one beside another. The refill 6 shown in FIG. 1 could therefore be replaced by two refills, each with magnetic elements 9*a*, 9*b* at the spine 6*c* which cooperate with the magnets 3*a*, 3*b* of the cover 2.

Furthermore, the cover 2 may include in its spine 2*c* a metal tab or a similar metal element arranged externally relative to the magnets 3*a*, 3*b*. This arrangement reduces the magnetic field beyond the stationery item 1. Such a metal tab further strengthens the magnetic attraction between the cover 2 and the refill or refills 6.

Although the spine 2*c* of the cover 2 is represented here as being flat, it is understood that the spine 2*c* may alternatively have a rounded profile. In this case, the inside face of the spine 2*c* is possibly concave and the magnets 3*a*, 3*b* have a rounded profile which may be similar to that of the spine 2*c* of the cover 2. The corresponding magnetic elements 9*a*, 9*b* of the refill 6 which allow attaching the refill 6 to the cover 2 may then have a convex surface of a shape complementary to the shape of magnets 3*a*, 3*b*.

Figure 9:
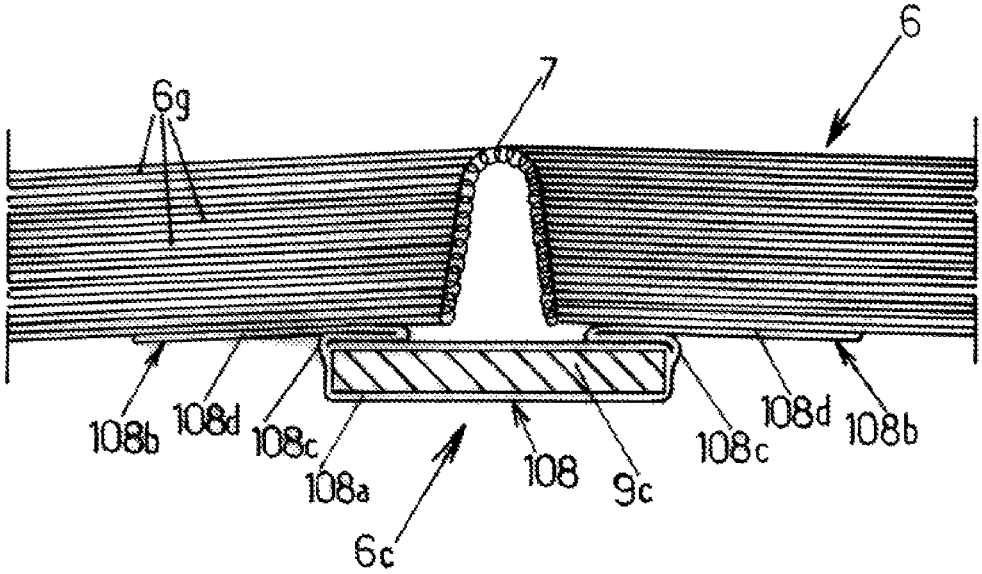
FIGS. 9 and 10 are sectional views of the refill according to second and third embodiments, in the open position.
Figure 10:
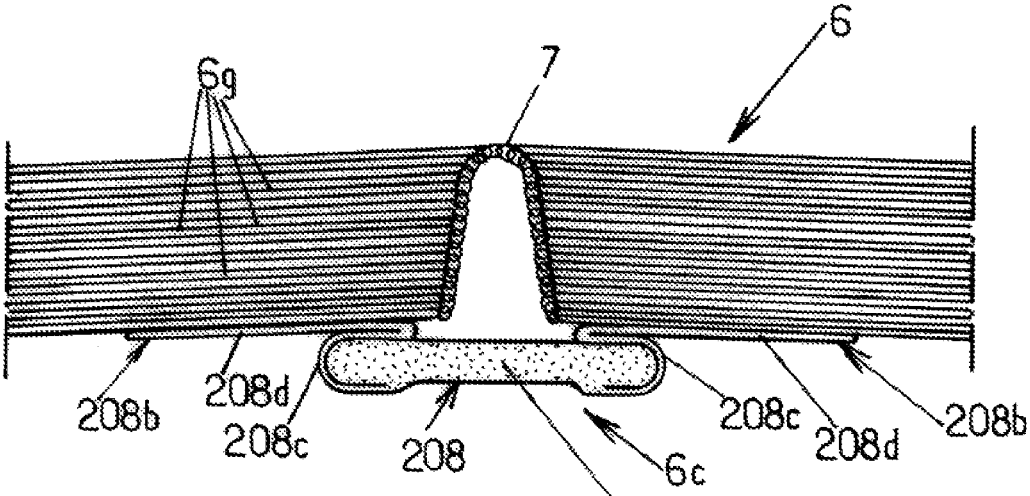

Three other embodiments will now be described with reference to FIGS. 8 to 10. Everything described above for the first embodiment applies to these alternative embodiments, which will therefore not be described in detail; only the differences between each of these other embodiments and the first embodiment will be described below.

Second Embodiment

Figure 8:
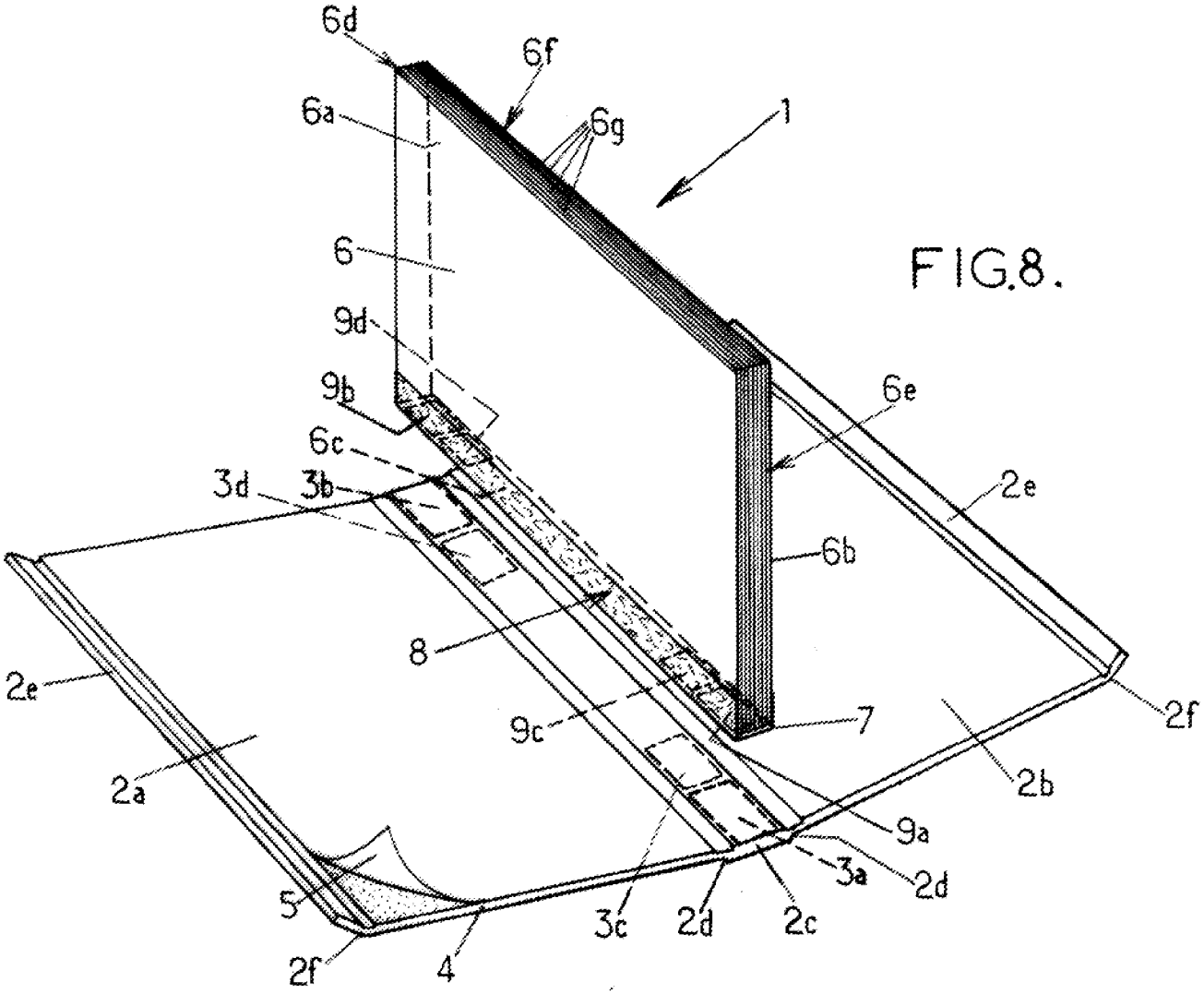
FIG. 8 is a perspective view showing a stationery item according to a second embodiment of the invention.

Referring to FIG. 8, the refill 6 is shown here as having a general form similar to the refill of the first embodiment, and essentially differs only in the number of similar magnets 9*a*, 9*b*, 9*c*, 9*d* or magnetic elements used. Here, four magnets 9*a*, 9*b*, 9*c*, 9*d* are arranged in alignment. Four magnets 3*a*, 3*b*, 3, 3*d* are then provided in the spine 2*c* of the cover, in a similar arrangement.

More generally, the number or shape of the magnetic elements can vary in order to implement the removable attachment by magnetic attraction to the spine 2*c* of the cover 2.

Third and Fourth Embodiments

In the third embodiment (FIG. 9), the covering strip 108 may optionally be molded as a piece of thermoplastic material which wraps or overmolds the magnetic element or elements 9*a*, 9*b*. The side portions 108*b* are flexibly connected to the spine portion 108*a* which encloses the magnet or magnets 9*a*. Each of the side portions 108*b* includes, as above, a free intermediate portion 108*c* and an end portion 108*d* which is adhesively or otherwise bonded to the main surfaces 6*a*, 6*b* of the pad of pages 6.

In the fourth embodiment (FIG. 10), the magnetic material may also be incorporated into the composition of a covering strip 208 which can be attached by its side portions 208*b* to the main surfaces of the pad of pages 6*g*. In this case, the spine portion 208*a* is formed of a composite material with a powder of ferromagnetic material dispersed in a matrix. A magnetic element is thus obtained that is incorporated into the spine portion 208*a* and is manufactured as one part with the side portions 208*b* which are thinner and therefore more flexible than the spine portion 208.

The side portions 208*b* are flexibly connected to the spine portion 208*a*. As above, each of the side portions 208*b* includes an intermediate free portion 208*c* and an end portion 208*d* adhesively or otherwise bonded to the main surfaces 6*a*, 6*b* of the pad of pages 6.

In the examples in FIGS. 3 to 7, 9 and 10, which show the use of a refill 6, it can be seen that the covering strip 8, 108, or 208 is attached to the pad of pages 6*g* only by the side portions 8*b*, 108*b*, 208*b*. This configuration is also usable for stationery items 1 with a permanent attachment to the pad of pages 6*g*.

Indeed, the inventors have observed that to allow the pages 6*g* to open and lie flat, the configuration of a stationery item 1 with a covering strip 8, 108, 208 can be used regardless of the mode of attachment (removable or non-removable) of the pad of pages 6*g*. More particularly, a stationery item 1 can be proposed that comprises:

- a cover 2 comprising at least a front cover board 2*a*, a back cover board 2*b*, and a spine 2*c* connecting the front and back cover boards 2*a*, 2*b*,
- a pad of pages 6*g*, comprising a plurality of stacked pages, said pad of pages forming:
  - two main outer surfaces 6*a*, 6*b* separated by a certain thickness $L_c$),
  - a spine 6*c* defining said thickness on one side of the pad,
- a binding 7 joining the pages 6*g* of the pad together at the spine 6*c* of the pad,
- attachment means integral to the spine 2*c* of the cover 2, for attaching said plurality of pages 6*g* in a manner that allows them to turn relative to the spine 2*c* of the cover 2, wherein the attachment means comprises the flexible covering strip 8, 108, 208 which has:

- a spine portion 8*a*, 108*a*, 208*a* externally covering the binding 7 and attached to the spine 2*c* of the cover 2, and
- two side portions 8*b*, 108*b*, 208*b* respectively attached to the two main surfaces of the pad of pages 6*g* and connected to the spine portion 8*a*, 108*a*, 208*a*, and wherein the flexible covering strip 8, 108, 208 further has, at a connection between the spine portion 8*a*, 108*a*, 208*a* and one of the two side portions 8*b*, 108*b*, 208*b*, a free and flexible portion (8*c*, 108*c*, 208*c*, 8*e*) which is arranged between the spine 2*c* of the cover 2 and an attachment portion which is part of the side portion 8*b*, 108*b*, 208*b*, said attachment portion being attached to the corresponding main surface 6*a*, 6*b* of the pad of pages 6*g*, said free and flexible portion (8*c*, 108*c*, 208*c*, 8*e*) not being attached to the spine 2*c* of the cover 2 or to the pad of pages 6*g* or to the binding 7.

According to another feature of the invention, the free and flexible portion (8*c*, 108*c*, 208*c*, 8*e*) completely covers a ridge formed between the spine 6*c* of the pad of pages 6*g* and one of the main surfaces 6*a*, 6*b*.

The invention claimed is:

1. A refill unit for a stationery item, comprising:

a pad of sheets of paper the sheets of paper being identical to form stacked pages and forming two main outer surfaces of the refill unit separated by a certain thickness in a closed configuration of the pad, which is a total thickness of the refill unit, a spine at one side of the pad, a binding that binds the sheets of paper together at the spine, magnetic means, arranged at the spine and configured to attach by magnetic attraction to a back of a foldable stationery item cover, the magnetic means being not included in the pad and extending for a width which is inferior or equal to said total thickness, a flexible covering strip, having:

a spine portion which externally covers the binding, the spine portion extending perpendicular to the two main outer surfaces in the closed configuration of the pad, and two side portions which are respectively attached to the two main outer surfaces of the pad and are connected to the spine portion, wherein the two main outer surfaces formed by said pad define two opposite uncovered outer surfaces of the refill unit in a completely closed configuration of the refill unit, so that the sheets of paper define the total thickness of the refill unit in said completely closed configuration, wherein the spine portion of the covering strip is provided with said magnetic means to define all or part of the spine of the refill unit, and wherein each of the two side portions of the covering strip comprises:

a free and flexible intermediate portion which extends laterally from the spine portion and is not attached to any one of the two main outer surfaces of the pad, and an end portion which extends from said intermediate portion and is non-magnetically attached to said corresponding main outer surface of the pad, the end portion being permanently secured to the pad and in contact with one of the two main outer surfaces at a portion adjacent to said intermediate portion.

2. The refill unit according to claim 1, wherein the magnetic means comprise a ferromagnetic material.

3. The refill unit according to claim 2, wherein said ferromagnetic material is permanently magnetized.

4. The refill unit according to claim 2, wherein said ferromagnetic material is a metal.

5. The refill unit according to claim 1, wherein the magnetic means comprise at least one magnetic element integral with the spine portion of the covering strip.

6. The refill unit according to claim 5, wherein the spine portion of the covering strip has a certain thickness and said magnetic element is included within said thickness, the refill having a parallelepiped volume when the pad is in the closed position.

7. The refill unit according to claim 5, wherein said magnetic element is attached to the spine portion of the covering strip facing the binding of said pad.

8. The refill unit according to claim 6, wherein the spine portion of the covering strip is integral with at least two magnetic elements spaced apart along the spine of the refill unit.

9. The refill unit according to claim 8, wherein the magnetic elements are arranged asymmetrically on the spine of the refill relative to a 180° rotation of the refill about an axis perpendicular to the spine of the refill unit.

10. The refill unit according to claim 8, wherein the magnetic elements are permanent magnets with non-parallel polarization relative to each other.

11. The refill unit according to claim 1, wherein the magnetic means comprise at least one magnetic material integrated into material of the spine portion of the covering strip.

12. The refill unit according to claim 1, wherein the spine portion of the covering strip has a certain width and the magnetic means comprise at least one rigid magnetic element which extends over a width that is less than the width of the spine portion, the spine portion having two free and flexible side strips which are not covered by said magnetic element and which connect to said side portions of the covering strip.

13. A stationery item comprising:

a refill unit that comprises a spine, a pad of sheets of paper, a binding that binds the sheets of paper of the pad together, the refill unit having a total thickness, a foldable cover comprising at least a front cover board, a back cover board, and a cover spine connecting the front and back cover boards, the cover spine being provided with magnetic means, the cover being distinct from the refill unit, wherein the forms in a closed configuration of the pad two main outer surfaces of the refill unit separated by a certain thickness that defines a total thickness of the refill unit, the two main outer surfaces formed by said pad being unprotected and defining two opposite outer surfaces of the refill unit in a completely closed configuration of the refill unit, wherein the refill unit further comprises:

an arrangement of magnetic elements, extending along the spine of the refill unit and configured to be attracted by the magnetic means of the cover, to allow the spine of the refill unit to be attached to the cover by magnetic attraction, the magnetic elements all extending for a width which is inferior or equal to said total thickness, a flexible covering strip, having:

a spine portion which externally covers the binding, and two side portions which are respectively attached to the two main outer surfaces of the pad and are connected to the spine portion, wherein the spine portion of the covering strip and said arrangement of magnetic elements form the spine of the refill unit, said spine of the refill unit being non-removably and non-magnetically secured to sheets of paper of the pad, and wherein the magnetic elements of the refill unit comprise a plurality of magnetic elements integral with the spine portion of the covering strip and the cover spine comprises a plurality of complementary magnetic elements each configured for magnetically attracting a magnetic element of the refill unit and arranged in correspondence with said magnetic elements of the refill unit.

14. The item according to claim 13, wherein the binding extends in a separated manner from the flexible covering strip so that the binding can be folded at a distance from the spine portion of the flexible strip.

15. A refill unit for a stationery item, comprising:

a pad of sheets of paper, comprising a plurality of sheets of paper to form stacked pages, said pad forming two main outer surfaces, the two main outer surfaces defining two opposite outer surfaces of the refill unit in a completely closed configuration of the refill unit, so that the stacked pages formed by the sheets of paper define a total thickness of the refill unit in said completely closed configuration, a spine defined at one side of the pad, a binding that binds the sheets of paper of the pad together at the spine, the pad of sheets of paper being only defined by sheets of paper, magnetic means configured to attach by magnetic attraction to a back of a foldable stationery item cover, the magnetic means being provided outside the pad and extending for a width which is inferior or equal to said total thickness, a flexible covering strip, distinct from the binding, having:

a spine portion provided with said magnetic means to define all or part of the spine of the refill unit, two side portions respectively attached to the two main outer surfaces of the pad, each of the two side portions provided with an end portion that is non-removably and non-magnetically secured to one of the two main outer surfaces of the pad, and at least one flexible intermediate portion that extends from the spine portion and is not attached to the two main outer surfaces of the pad.

16. The refill unit according to claim 15, wherein the magnetic means comprise a rigid magnetic element so that the spine of the refill unit is rigid.

17. The refill unit according to claim 1, wherein in an open flat configuration of the refill unit, in each of the two side portions of the covering strip, said flexible intermediate portion is configured to fold along the magnetic means to define a fold between the magnetic means and the end portion.

18. The refill unit according to claim 17, wherein in each of the two side portions of the covering strip, the end portion is fully planar.

19. The refill unit according to claim 15, wherein in an open flat configuration of the refill unit, said flexible intermediate portion is configured to fold along the magnetic means to define a fold between the magnetic means and a planar end portion that belongs to one of the two side portions.

20. The item according to claim 13, wherein in an open flat configuration of the item:

each of the two main outer surfaces of the pad are in direct contact with the cover, each magnetic element of the arrangement of magnetic elements extends parallel to the spine cover, and the two side portions of the flexible covering strip each define two folding lines that are adjacent to the arrangement of magnetic elements and spaced from each other from a distance shorter than the total thickness.

* * * * *